US010166422B2

(12) United States Patent
Hsiang

(10) Patent No.: US 10,166,422 B2
(45) Date of Patent: Jan. 1, 2019

(54) TRAMPOLINE SUPPORT FRAME

(71) Applicant: Crowntec (Jiang Xi) Sports Technology Co. Ltd., Jiujiang, Jiangxi Province (CN)

(72) Inventor: Hua-Lu Hsiang, Taoyuan (TW)

(73) Assignee: CROWNTEC (JIANG XI) SPORTS TECHNOLOGY CO. LTD., Jiujiang (CN)

( * ) Notice: Subject to any disclaimer, the term of this patent is extended or adjusted under 35 U.S.C. 154(b) by 171 days.

(21) Appl. No.: 15/285,963

(22) Filed: Oct. 5, 2016

(65) Prior Publication Data

US 2018/0093119 A1 Apr. 5, 2018

(51) Int. Cl.

*A63B 5/11* (2006.01)
*A63B 71/04* (2006.01)
*A63B 71/02* (2006.01)

(52) U.S. Cl.

CPC ..... *A63B 5/11* (2013.01); *A63B 71/022* (2013.01); *A63B 71/023* (2013.01); *A63B 71/04* (2013.01)

(58) Field of Classification Search

CPC .... A63B 5/08; A63B 5/11; A63B 5/16; A63B 2005/085
USPC ..... 285/133.11
See application file for complete search history.

(56) References Cited

U.S. PATENT DOCUMENTS 1,823,028 A * 9/1931 Caldwell ..... B21D 39/044 219/107
1,941,465 A * 1/1934 Cornell, Jr. ..... F16L 41/084 285/133.11
5,488,810 A * 2/1996 Horton ..... E04B 1/2608 403/178
8,137,242 B2 * 3/2012 VanElverdinghe ..... A63B 5/11 482/27
2004/0091307 A1 * 5/2004 James ..... F16B 7/04 403/188
2004/0176214 A1 * 9/2004 Yueh ..... A63B 5/11 482/27

(Continued)

FOREIGN PATENT DOCUMENTS

CN 201082327 Y 7/2008
CN 202001453 U 10/2011

*Primary Examiner* — Nyca T Nguyen
(74) *Attorney, Agent, or Firm* — Muncy, Geissler, Olds & Lowe, P.C.

(57) ABSTRACT

A trampoline support frame comprises transversal and longitudinal branch pipes. The transversal ones are connected to form an annular frame. Each longitudinal one is provided with a fitting portion and two reinforcing portions integrally extended from the fitting portion to corresponding two side surfaces of the transversal one and then fixed to the transversal one by welding. The two reinforcing portions of each longitudinal one are extended from and integrally formed with the fitting portion, such that each transversal one is fixed to the two reinforcing portions by welding directly after the transversal one is placed between the two reinforcing portions without precision alignment, whereby the manufacturing process for the trampoline support frame is simplified, and manufacturing energy consumption is reduced to meet requirements for environment protection. Assembling strength between two opposite outer side surfaces of each transversal one and each longitudinal one is strengthened by the two reinforcing portions.

6 Claims, 5 Drawing Sheets

(56) References Cited

U.S. PATENT DOCUMENTS

| | | | | |
|---|---|---|---|---|
| 2007/0049463 | A1* | 3/2007 | Chu | A63B 5/11 482/27 |
| 2010/0075810 | A1* | 3/2010 | Schaffer | A63B 5/11 482/27 |
| 2010/0240496 | A1* | 9/2010 | Chen | A63B 5/11 482/27 |
| 2012/0054999 | A1* | 3/2012 | Hsiang | A63B 5/11 29/428 |
| 2012/0289379 | A1* | 11/2012 | Stokes | A63B 5/11 482/27 |
| 2013/0045837 | A1* | 2/2013 | Hsiang | A63B 5/11 482/27 |
| 2017/0108152 | A1* | 4/2017 | Hsiang | F16L 41/021 |
| 2017/0312563 | A1* | 11/2017 | Chen | A63B 5/11 |
| 2018/0093120 | A1* | 4/2018 | Chen | A63B 5/11 |

* cited by examiner

TRAMPOLINE SUPPORT FRAME

FIELD OF THE INVENTION

The present invention is related to a trampoline support frame, particularly to a trampoline support frame with high assembling strength and simplified manufacturing process for meeting requirements for environment protection.

BACKGROUND OF THE INVENTION

It is found that the structure of trampoline support frame has also become key technology gradually in the improvement of trampoline due to a large amount of jumps and bumps generally arising when a trampoline is used by a user. For instance, China patent publication no. CN202001453 disclosed a connecting structure of trampoline frame comprising a cross rod and a vertical rod. One end of the vertical rod is provided with an annular faucet fixed to the cross rod by welding. Further, China patent publication no. CN201082327 also disclosed an improved trampoline comprising an annular frame, an elastic net, a plurality of supporting components and a plurality of retaining plates. The elastic net is provided at inner side of the annular frame. The supporting components are used for supporting at the bottom of the annular frame, respectively. In this case, each of the supporting components and the annular frame are welded together via the retaining plates so as to be fixed.

It may be found in the technical contents of above two patents, however, there is none of fixing structure between two side surfaces adjacent to the bottom of the cross rod and the vertical rod, because the vertical rod is only fixed to the bottom of the cross rod by welding in the patent no. CN202001453, which further leads to the break of the cross rod with respect to the vertical rod readily generated due to impact force during the trampoline is used. In the patent no. CN201082327, additionally, although one side of the annular frame may be fixed to the supporting component by welding via the retaining plate, there is a problem of insufficient assembling strength owing to none of fixing structure between another side of the annular frame and the supporting component. Furthermore, it may be further found, from the viewpoint of assembling process of the trampoline, that it is necessary to align the retaining plate with the supporting component and the side of annular frame after the supporting component and the annular frame are assembled, followed by fixing the retaining plate at two sides thereof to the supporting component and the annular frame by welding, respectively, via welding equipment. As a result, the increased manufacturing cost due to excessively complicated manufacturing process and the problem of environment protection, such as excessive manufacturing energy consumption, may occur in the trampoline.

SUMMARY OF THE INVENTION

It is the main object of the present invention to solve the problems of insufficient assembling strength at sides and excessively complicated manufacturing process resulting in excessive energy consumption in the prior art.

For achieving the above object, the present invention provides a trampoline support frame comprising a plurality of transversal branch pipes connected to each other so as to form an annular frame provided for a bouncing component to be mounted at inner side thereof, and a plurality of longitudinal branch pipes provided to one of the transversal branch pipes, characterized in that each of the longitudinal branch pipes is respectively provided with a fitting portion, two reinforcing portions integrally extended from the fitting portion to corresponding two side surfaces of the transversal branch pipe and then fixed to the transversal branch pipe by welding, an accommodating space formed between the two reinforcing portions and provided for one of the transversal branch pipes to be located therein, and two bearing surfaces, each of which is formed between two ends of the two reinforcing portions and toward the accommodating space so as to support one of the transversal branch pipes.

In one embodiment, each of the transversal branch pipes is respectively provided with a curved portion, a first connecting portion provided at one end of the curved portion, and a second connecting portion provided at another end of the curved portion and covering while being fixed to the first connecting portion of another transversal branch pipe. In this case, the first connecting portion is provided with a first opening, and the second connecting portion is provided with a second opening covering the first opening. Specifically, each of the first connecting portions is provided with two first stepped surfaces located at two opposite outer sides of the first opening while in parallel with each other, respectively. Each of the second connecting portions is provided with two second stepped surfaces located at two opposite outer sides of the second opening while in parallel with the two first stepped surfaces, respectively. The two reinforcing portions of each of the longitudinal branch pipes are attached to the two second stepped surfaces by welding. Further, each of the first connecting portions is provided with two first curved surfaces connected to the two first stepped surfaces and being opposite to each other, respectively. Each of the second connecting portions is provided with two second curved surfaces connected to the two second stepped surfaces and being opposite to each other so as to be located at two opposite outer sides of the two first curved surfaces, respectively. The two bearing surfaces of each of the longitudinal branch pipes are attached against one of the second curved surfaces.

In one embodiment, the two reinforcing portions of each of the longitudinal branch pipes are extended more than one-half of width of the two second stepped surfaces.

In one embodiment, each of the longitudinal branch pipes is provided with at least one additive weld hole provided in one of the reinforcing portions, respectively, in such a way that the reinforcing portion is fixed at inner side thereof to the second stepped surface by welding.

In one embodiment, the trampoline support frame further comprises a plurality of connecting pipes provided in one of the fitting portions, respectively, and a plurality of supporting pipes mounted while connected to the adjacent two connecting pipes at one side far away from the fitting portion. Further, the trampoline support frame further comprises a plurality of pipes for enclosure net mounted and fixed to the outside of one of the longitudinal branch pipes and one of the connecting pipes, respectively, while extended toward one side far away from the supporting pipe, for allowing a safety net to be mounted thereto.

In comparison with the prior art, the features of above embodiments of the present invention are as follows.

In the present invention, the two reinforcing portions of each of the longitudinal branch pipes are extended from and integrally formed with the fitting portion, such that the two reinforcing portions of each of the longitudinal branch pipes may be welded to the surface of each of the transversal branch pipes directly after the transversal branch pipe is placed into the accommodating space. Thereby, the manufacturing process for the trampoline support frame is simplified, and manufacturing energy consumption is reduced so as to achieve requirements for environment protection. Additionally, assembling strength between each of the longitudinal branch pipes and two outer side surfaces of one of the transversal branch pipes is strengthened through the two reinforcing portions of the longitudinal branch pipe. As a result, the problems of excessively complicated manufacturing process and insufficient assembling strength at sides in the prior art may be then solved by the above-mentioned structure.

DETAILED DESCRIPTION OF THE PREFERRED EMBODIMENTS

The detailed description and technical solution with respect to the present invention will be now described in conjunction with the drawings as follows.

Figure 1:
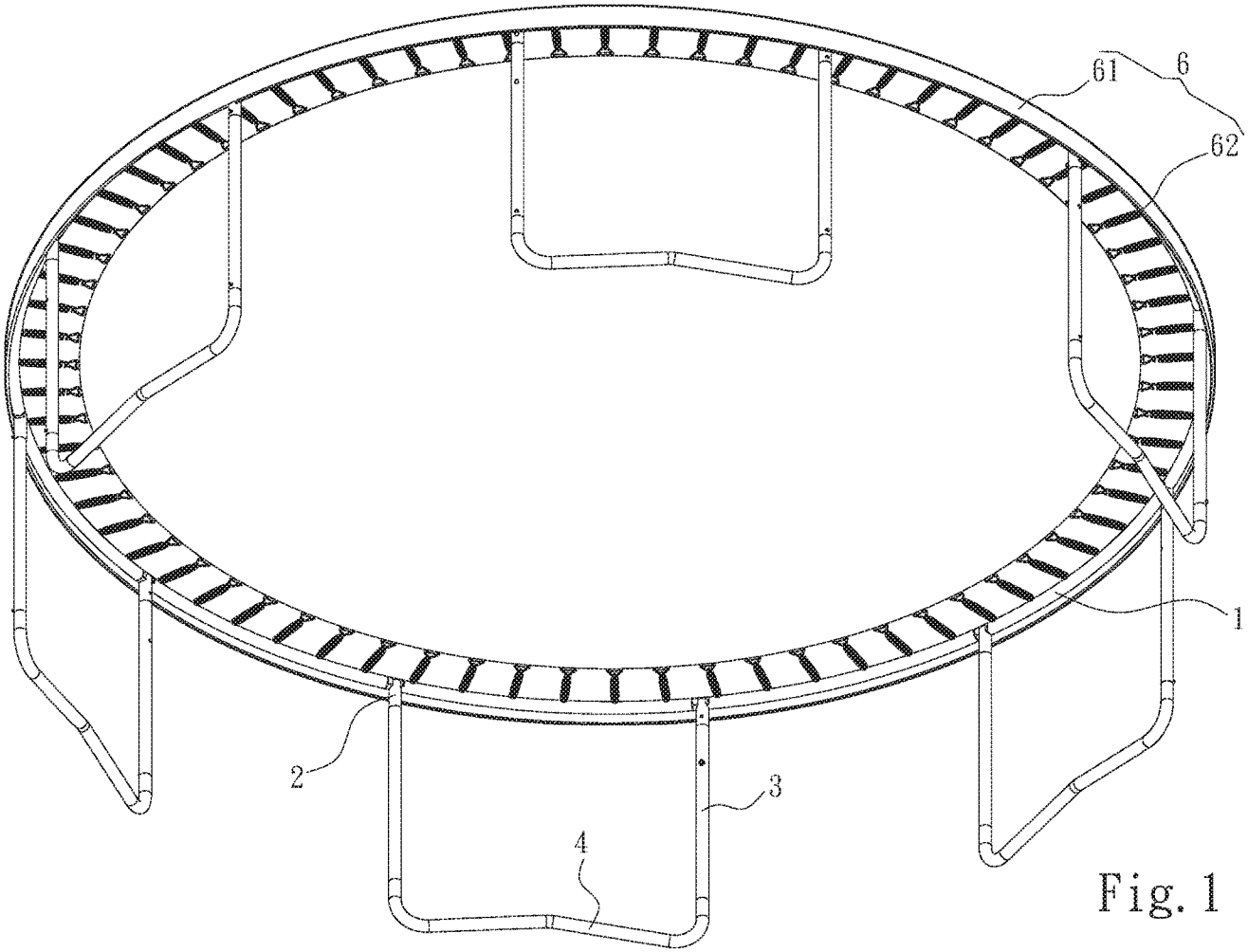
FIG. 1 is a perspective diagram of the present invention.
Figure 2:
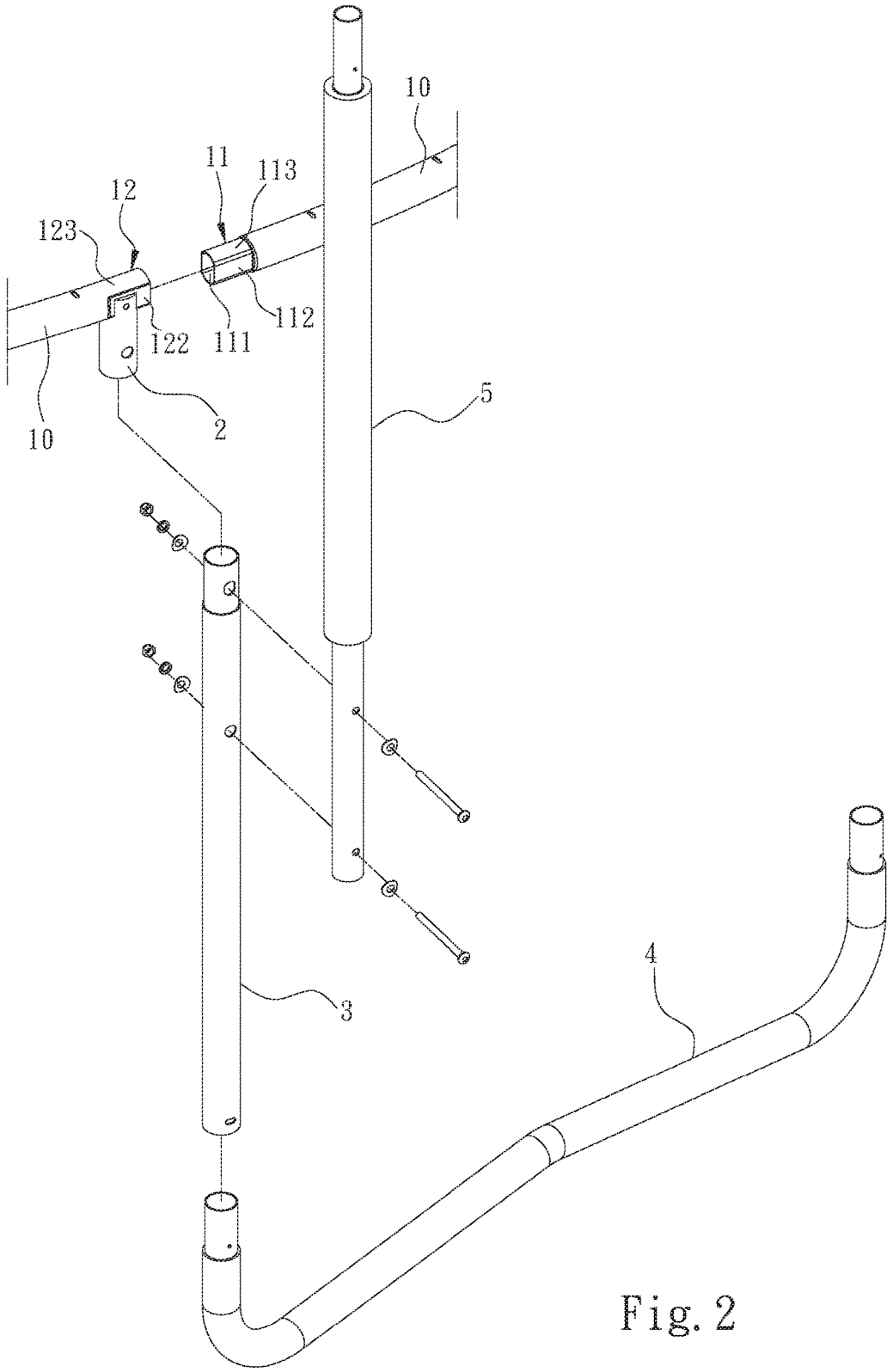
FIG. 2 is an exploded diagram of the present invention.

Referring to FIGS. 1 to 4, the present invention provides a trampoline support frame comprising a plurality of transversal branch pipes 1 and a plurality of longitudinal branch pipes 2. Each of the longitudinal branch pipes 2 is provided with a fitting portion 21, two reinforcing portions 22, an accommodating space 23 and two bearing surfaces 24, respectively. The two reinforcing portions 22 are extended from and integrally formed with the fitting portion 21, while corresponded to each other. The accommodating space 23 is defined and formed between the two reinforcing portions 22. Each of the two bearing surfaces 24 is formed between two ends of the two reinforcing portions 22 and toward the accommodating space 23. In this case, each of the two reinforcing portions 22 of the longitudinal branch pipe 2 is in the form of a plate, and the two reinforcing portions 22 are mirrored with respect to the center line of the longitudinal branch pipe 2 as a symmetric line. Further, when the trampoline support frame of the present invention is assembled, the transversal branch pipes 1 are connected to each other so as to form an annular frame, in such a way that a bouncing component 6 is allowed to be mounted at the inner side of the transversal branch pipes 1. In one embodiment, the bouncing component 6 comprises a plurality of springs 61 connectingly mounted to the annular frame (i.e., the transversal branch pipes 1), and an elastic net 62 provided at the inner side of the springs 61 and tensioned by the springs 61, as illustrated in FIG. 1.

Then, each of the longitudinal branch pipes 2 is evenly located on the edge of the annular frame, such that each of the transversal branch pipes 1 is placed into the accommodating space 23 and supported by the bearing surfaces 24. The two reinforcing portions 22 of each of the longitudinal branch pipes 2 are attached to two corresponding side surfaces of one of the transversal branch pipes 1. As a result, welding equipment (not shown in the figures) is just used for fixing the two reinforcing portions 22 and the two bearing surface 24 of each of the longitudinal branch pipes 2 to the surface of one of the transversal branch pipes 1 by welding, respectively, such that the outer edge (i.e., the edge of the two reinforcing portions 22 and the edge of the two bearing surfaces 24) at one end of the longitudinal branch pipe 2 is fixed to the transversal branch pipe 1 completely by welding. In this case, the two reinforcing portions 22 of each of the longitudinal branch pipes 2 are extended from and integrally formed with the fitting portion 21, such that the two reinforcing portions 22 of each of the longitudinal branch pipes 2 may be welded to the surface of each of the transversal branch pipes 1 directly after the transversal branch pipe 1 is placed into the accommodating space 23 without precision alignment. Moreover, amount of material to be used during manufacturing process may be reduced, so as to avoid unnecessary waste of raw material. Thereby, the manufacturing process for the trampoline support frame may be simplified, and manufacturing energy consumption may be reduced so as to achieve requirements for environment protection. Furthermore, assembling strength between each of the longitudinal branch pipes 2 and two outer side surfaces of one of the transversal branch pipes 1 is further strengthened, respectively, through the two reinforcing portions 22. As such, the problems of excessively complicated manufacturing process and insufficient assembling strength at sides in the prior art may be then solved.

Figure 3:
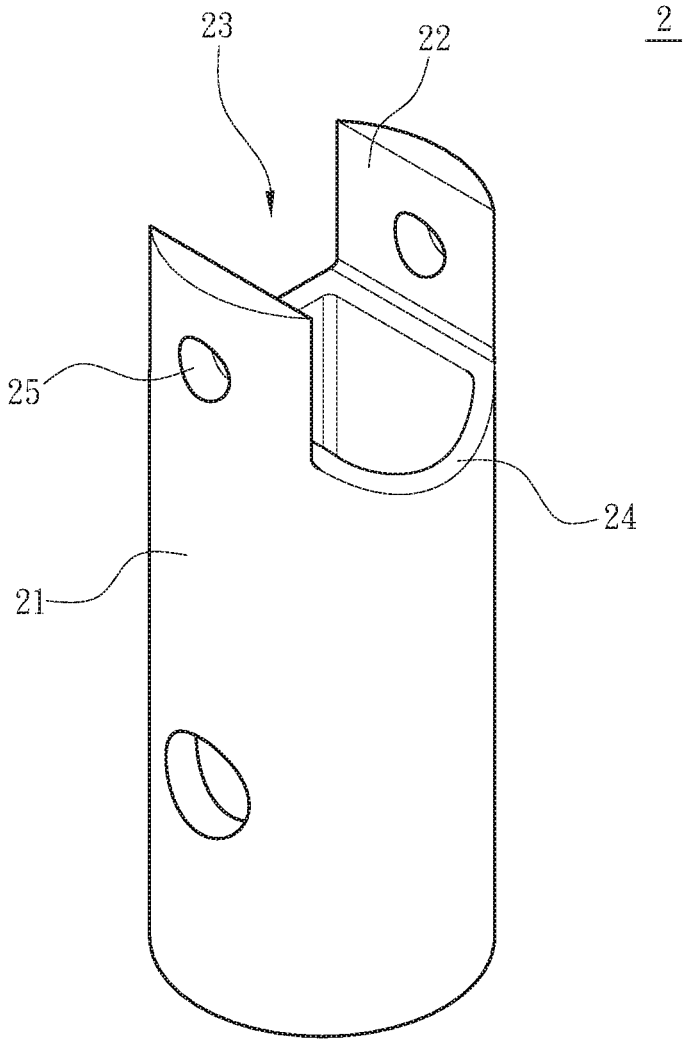
FIG. 3 is a perspective diagram of a longitudinal branch pipe of the present invention.
Figure 4:
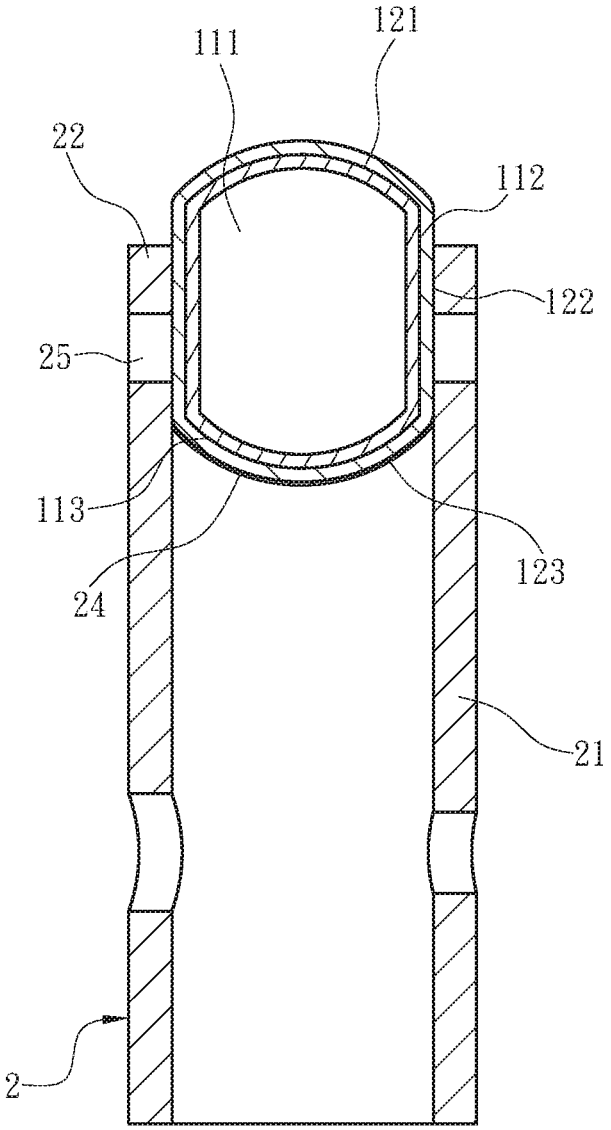
FIG. 4 is a cross-section diagram in which the present invention is embodied.

Next, the main technical feature of the trampoline support frame may be clearly seen in the above technical content. Here, embodiments and other technical contents of the trampoline support frame will be further described in the present invention. Specifically, each of the transversal branch pipes 1 is provided with a curved portion 10, a first connecting portion 11 provided at one end of the curved portion 10, and a second connecting portion 12 provided at another end of the curved portion 10, respectively. The second connecting portion 12 of each of the transversal branch pipes 1 is coveringly provided over the first connecting portion 11 of adjacent transversal branch pipe 1. In this case, each of the first connecting portions 11 is provided with a first opening 111, and two first stepped surfaces 112 located at two opposite outer sides of the first opening 111 while in parallel with each other, respectively. Each of the second connecting portions 12 is provided with a second opening 121 covering one of the first openings 111, and two second stepped surfaces 122 located at two opposite outer sides of the second opening 121 while in parallel with the two first stepped surfaces 112, respectively. Each of the two reinforcing portions 22 of the longitudinal branch pipe 2 is then in parallel with each other and extended to attach to the outside of the two second stepped surfaces 122 (illustrated in FIGS. 2 to 4). As a result, in addition to fixing the two reinforcing portions 22 to the two second stepped surfaces 122 by welding, respectively, retaining the two reinforcing portions 22 to the two second stepped surfaces 122 is further used for the longitudinal branch pipe 2, so as to enhance the overall assembling strength of the trampoline support frame. Besides, each of the first connecting portions 11 may be provided with two first curved surfaces 113 connected to the two first stepped surfaces 112 and being opposite to each other, respectively. Each of the second connecting portions 12 is provided with two second curved surfaces 123 connected to the two second stepped surfaces 122 and being opposite to each other so as to be located at two opposite outer surfaces of the two first curved surfaces 113. The two bearing surfaces 24 of each of the longitudinal branch pipes 2 are then attached against one of the second curved surfaces 123, as illustrated in FIGS. 3 and 4. Accordingly, impact force generated from the bouncing component 6 by a user on the transversal branch pipes 1 may be then evenly distributed by each of the longitudinal branch pipes 2 via the two curved bearing surfaces 24.

Particularly, the two reinforcing portions 22 of each of the longitudinal branch pipes 2 are extended more than one-half of width of the two second stepped surfaces 122 (as illustrated in FIG. 4), such that each of the transversal branch pipes 1 may be fixed, at two opposite outer sides thereof, to the two reinforcing portions 22 by welding in a large area, so as to enhance assembling strength.

In one embodiment, further, each of the longitudinal branch pipes 2 is provided with at least one additive weld hole 25 provided in one of the reinforcing portions 22, respectively, for the enhancement of assembling strength between each of the transversal branch pipes 1 and each of the longitudinal branch pipes 2. The additive weld hole 25 may be allowed for the welding equipment to weld the inner side of the reinforcing portion 22 to the second stepped surface 122 in a welding manner, whereby the welding area and strength between the reinforcing portion 22 and the second stepped surface 122 are enhanced. In this case, the welding manner is plug weld.

Figure 5:
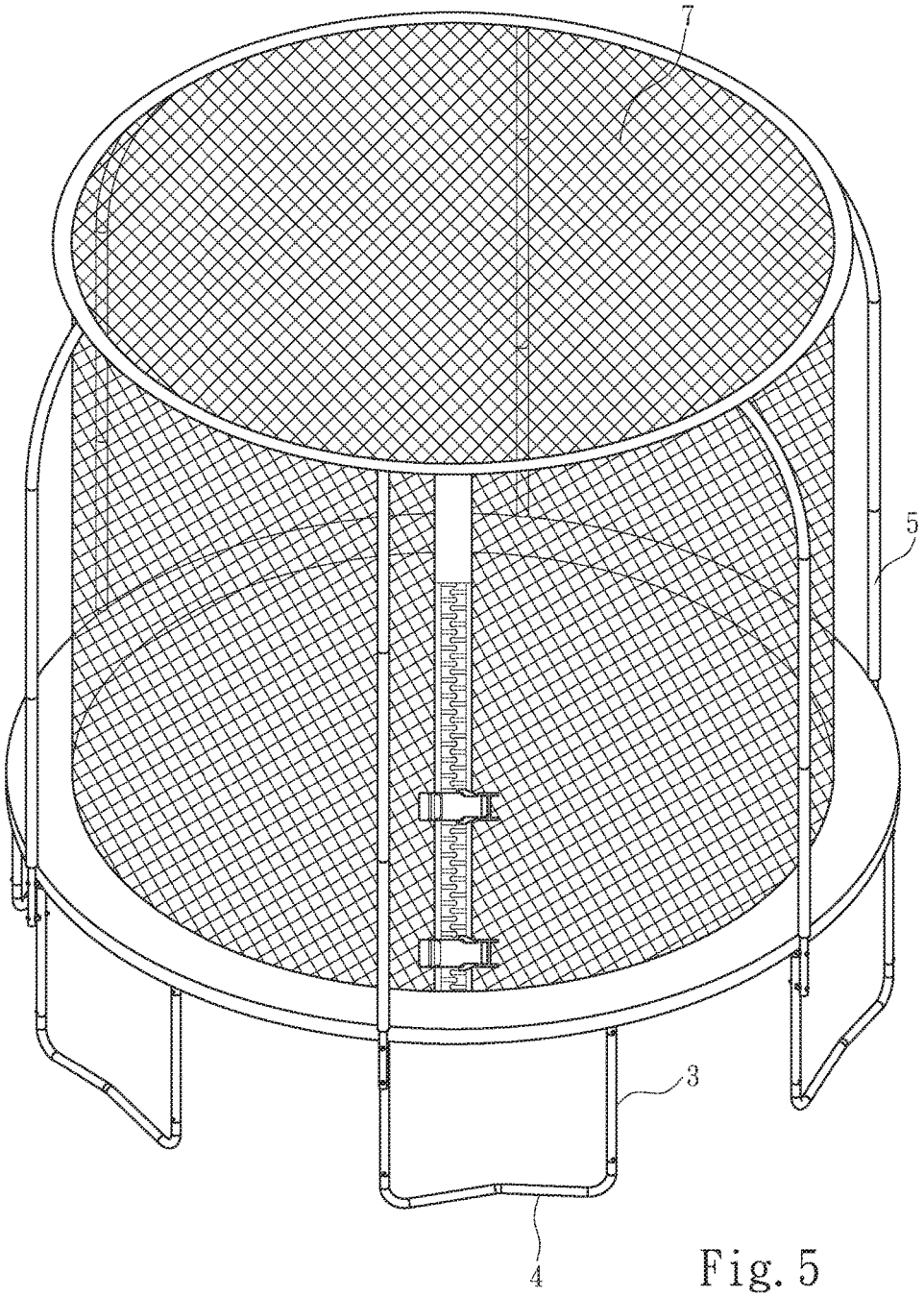
FIG. 5 is a perspective diagram of another embodiment of the present invention.

Referring to FIGS. 1, 2 and 5 again, on the other hand, the trampoline support frame further comprises a plurality of connecting pipes 3 and a plurality of supporting pipes 4. Each of the connecting pipes 3 is provided in one of the fitting portions 21, respectively, while each of the supporting pipes 4 is then mounted to the adjacent two connecting pipes 3 at one side far away from the fitting portion 21, such that a buffering space is formed between the annular frame and the ground through the connecting pipes 3 for allowing bounce of the user performed on the bouncing component 6, while stability of installation of the trampoline support frame is enhanced through multi-point contact between the supporting pipes 4 and the ground. In one embodiment, the trampoline support frame further comprises a plurality of pipes for enclosure net 5. Each of the pipes for enclosure net 5 is mounted and fixed to the outside of one of the longitudinal branch pipes 2 and one of the connecting pipes 3, respectively, while extended toward one side far away from the supporting pipe 4, for allowing a safety net 7 to be mounted thereto. Thus, tumbling off the trampoline support frame during bounding on the bouncing component 6 is avoided for the user by barrier provided by the safety net 7.

What is claimed is:

1. A trampoline support frame comprising a plurality of transversal branch pipes connected to each other so as to form an annular frame provided for a bouncing component to be mounted at inner side thereof, and a plurality of longitudinal branch pipes provided to one of said transversal branch pipes, characterized in that each of said longitudinal branch pipes is respectively provided with a fitting portion, two reinforcing portions integrally extended from said fitting portion to corresponding two side surfaces of said transversal branch pipe and then fixed to said transversal branch pipe by welding, an accommodating space formed between said two reinforcing portions and provided for one of said transversal branch pipes to be located therein, and two bearing surfaces, each of which is formed between two ends of said two reinforcing portions and toward said accommodating space so as to support one of said transversal branch pipes; wherein each of said transversal branch pipes is respectively provided with a curved portion, a first connecting portion provided at one end of said curved portion, and a second connecting portion provided at another end of said curved portion and covering while being fixed to said first connecting portion of another transversal branch pipe, and said first connecting portion is provided with a first opening, and said second connecting portion is provided with a second opening covering said first opening, each of said first connecting portion is respectively provided with two first stepped surfaces located at two opposite outer sides of said first opening while in parallel with each other, and each of said second connecting portions is respectively provided with two second stepped surfaces located at two opposite outer sides of said second opening while in parallel with said two first stepped surfaces, said two reinforcing portions of each of said longitudinal branch pipes being attached to said two second stepped surfaces by welding.

2. The trampoline support frame according to claim 1, wherein said two reinforcing portions of each of said longitudinal branch pipes are extended more than one-half of width of said two second stepped surfaces.

3. The trampoline support frame according to claim 2, wherein each of said longitudinal branch pipes is respectively provided with at least one additive weld hole provided in one of said reinforcing portions, such that said reinforcing portion is fixed at inner side thereof to said second stepped surface by welding.

4. The trampoline support frame according to claim 3, wherein said trampoline support frame further comprises a plurality of connecting pipes respectively provided in one of said fitting portions, and a plurality of supporting pipes mounted while connected to said adjacent two connecting pipes at one side far away from said fitting portion.

5. The trampoline support frame according to claim 4, wherein said trampoline support frame further comprises a plurality of pipes for enclosure net respectively mounted and fixed to the outside of one of said longitudinal branch pipes and one of said connecting pipes while extended toward one side far away from said supporting pipe, for allowing a safety net to be mounted thereto.

6. The trampoline support frame according to claim 1, wherein each of said first connecting portions is respectively provided with two first curved surfaces connected to said two first stepped surfaces and being opposite to each other, and each of said second connecting portions is respectively provided with two second curved surfaces connected to said two second stepped surfaces and being opposite to each other so as to be located at two opposite outer sides of said two first curved surfaces, said two bearing surfaces of each of said longitudinal branch pipes being attached against one of said second curved surfaces.

* * * * *